US006162110A

United States Patent [19]

Szumowski

[11] Patent Number: 6,162,110

[45] Date of Patent: Dec. 19, 2000

[54] DIABOLO ACCESSORY

[76] Inventor: Edzui Leon Szumowski, 1723 Rusty Nail Way, Las Vegas, Nev. 89119

[21] Appl. No.: 09/223,654

[22] Filed: Dec. 30, 1998

[51] Int. Cl.[7] ..... A63H 27/127

[52] U.S. Cl. ..... 446/255; 273/407; 273/410; 473/476

[58] Field of Search ..... 446/255, 247; 273/398, 401, 402, 407, 408, 410; 473/415, 422, 421, 454, 439, 476, 468

[56] References Cited

U.S. PATENT DOCUMENTS

| | | | |
|---|---|---|---|
| 3,312,467 | 4/1967 | Dawson | 474/454 |
| 5,944,318 | 8/1999 | Payton | 273/402 |

*Primary Examiner*—Jacob K. Ackun
*Assistant Examiner*—Jeffrey D. Carlson
*Attorney, Agent, or Firm*—Mario A. Martella; Beehler & Pavitt

[57] ABSTRACT

An accessory for diabolo juggling may take the form of hand held unit or a free standing unit. In each case, at least one stretchable, flexible, resilient and elastic member is supported by a frame. The elastic member, preferably a bungee cord, is free of any cross-member and in spaced parallel relation to any additional elastic members such that there is an unobstructed region on each side of the elastic member. In one form, there is a horizontal and vertical frame member with a plurality of elastic members supported in spaced parallel relation on transverse members mounted on the frame members. In use the diabolo is propelled toward the accessory, impinges on one or more cords and is propelled away due to the resilient nature of the cords. The free space on each side of the cord permits passage of the cones of the diabolo on each side of the cord to prevent the cone from contacting a fixed component of the accessory and thus slowing down the rotation of the diabolo.

20 Claims, 4 Drawing Sheets

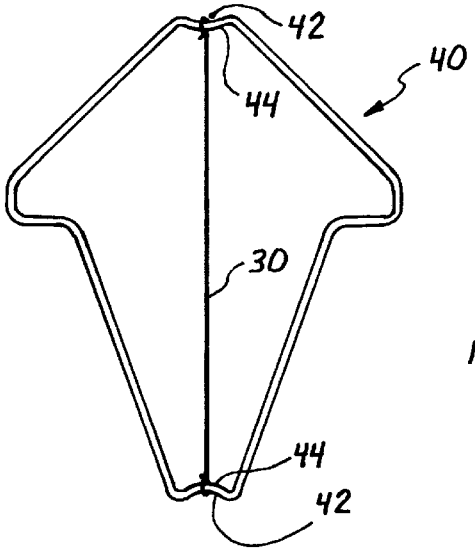
Fig. 3
Fig. 6
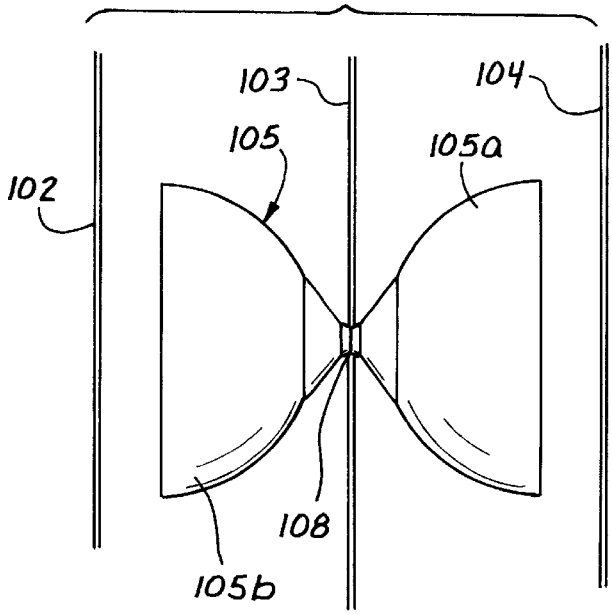
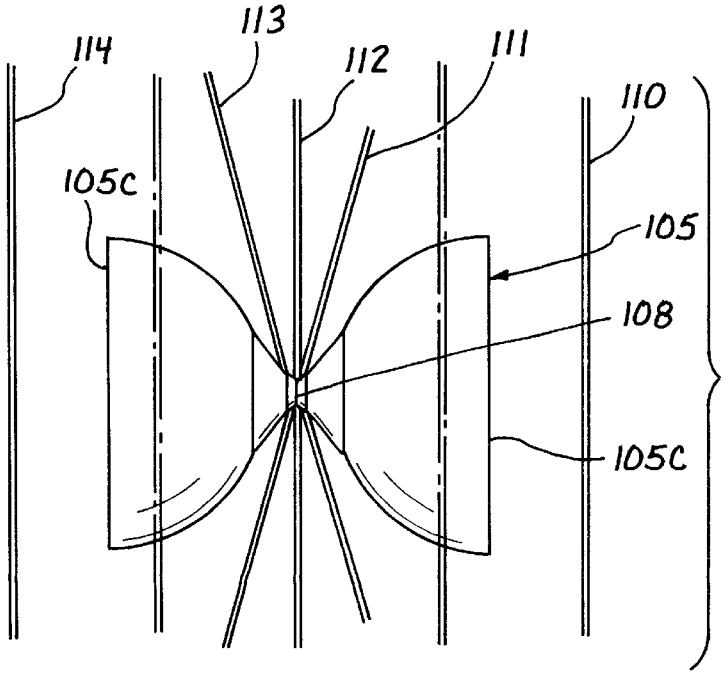
Fig. 7

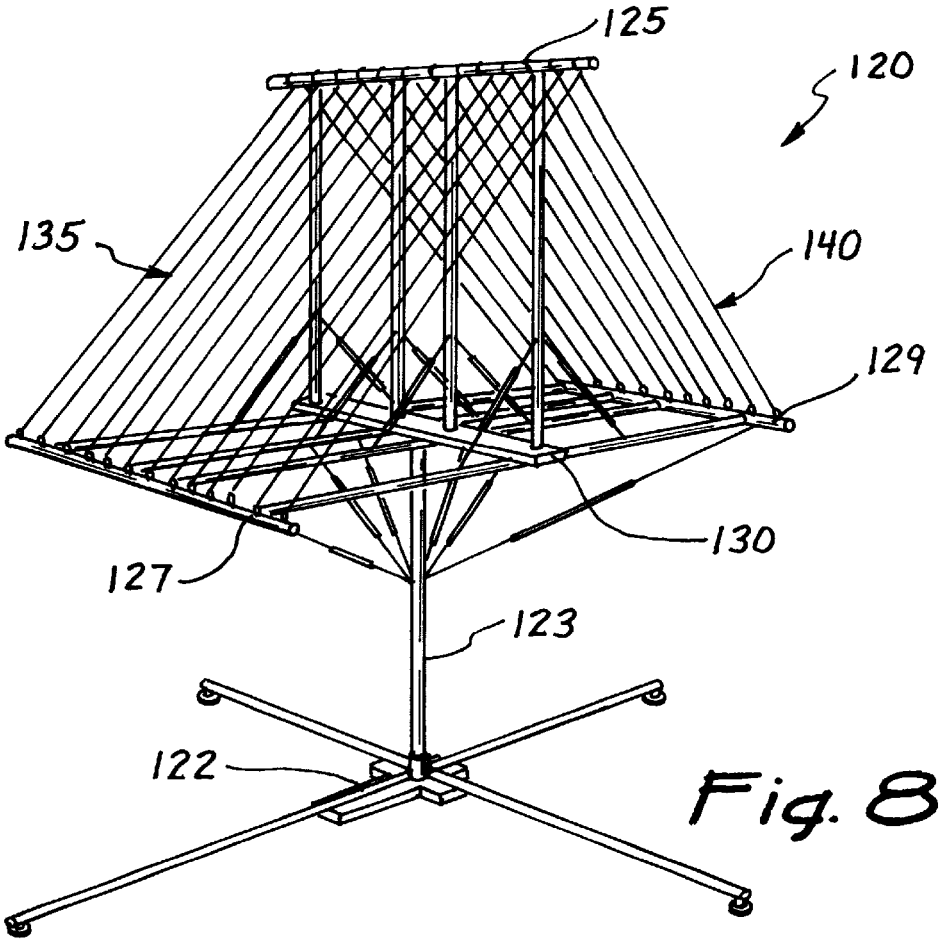
Fig. 8
Fig. 9
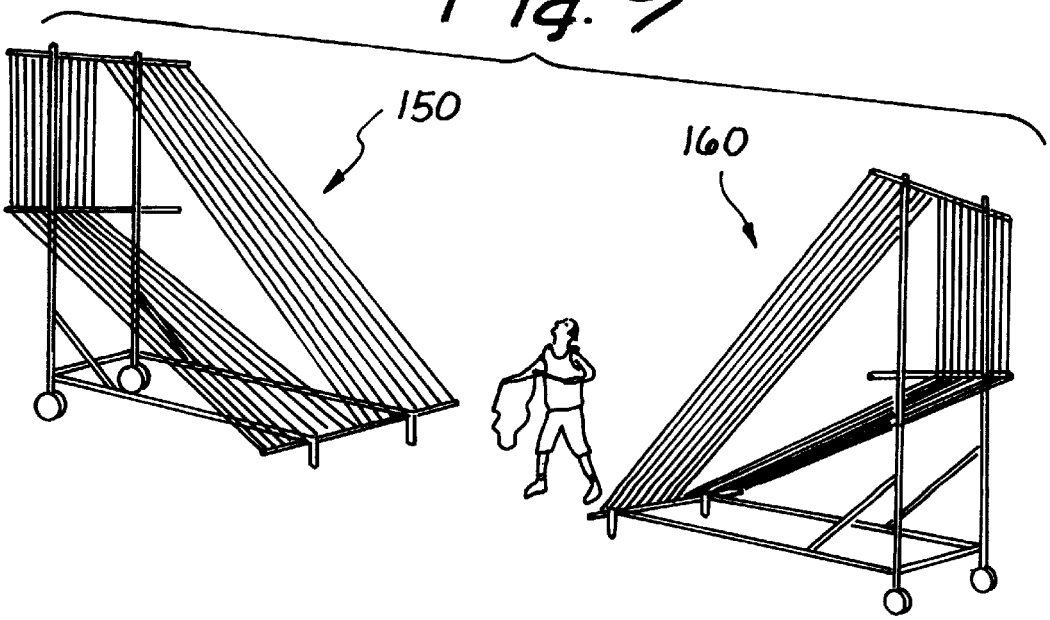

DIABOLO ACCESSORY

FIELD OF INVENTION

This invention relates to a diabolo juggling device and toy and more particularly to a novel accessory device for use in diabolo juggling and which includes at least one flexible and resilient and stretchable cord on which the diabolo impinges for bouncing the diabolo in a controlled direction.

BACKGROUND OF THE INVENTION

Diabolo playing and juggling has reportedly been known for centuries, supposedly starting in China more than 4,000 years ago. It is said that French and English missionaries and diplomats brought the diabolo to Europe where it was initially named diaballo from the Greek root, dia, meaning across and ballo meaning throw, and now shortened to diabolo.

During the First World War, interest in the diabolo waned and it was seen only in theaters and on stages. In the 1980's advances in technology and manufacturing led to a revival of interest in the diabolo. More and more jugglers and players took up the game with talented diabolists manipulating 2, 3 and even 4 diabolos used at one time.

In general, the modern day diabolo includes two frusto-conical cups mounted, normally bolted, on a central axle which holds the cups in spaced relation with the apex of the cups facing each other. Each of the cups includes a cone which faces each other, with an exposed portion of the axle between the cones. The side walls of the cones flare outwardly and may be curved or straight. Normally the inside of the cups are hollow or open. It is apparent that the diabolo's balance must be perfect and the structure quite rigid, as well as being shock-resistant and durable. Typically, the modern diabolo is made of a polyamide or rubber or other high strength material. Frequently, they are decorated with various designs and may include apertures in the cone wall so that the diabolo whistles when it is spinning at high rotational speed along its axis.

The diabolo element may vary in size both in diameter of the cones and the overall length between the end faces of the cones, it being of the utmost importance that the unit be in perfect balance along the axis and transverse of the axis of the diabolo. This is because the use of the diabolo requires that it be rotating along its axis, as contrasted to wobbling or gyrating. The cone diameter may vary from 6.5 cm to 12 cm, for example, and the axial length may vary from 10.5 cm to 13.5 cm, it being understood that the diabolo may be of other dimensions.

Use of the diabolo involves a pair of sticks, usually wood such as beech or pine, each about 18 inches long and about 12 mm in diameter and with a handle at one end and a special string tied at the other end of the sticks. In most cases, the string is flexible, non-elastic and non-stretchable and typically is made of 50% cotton and 50% nylon for strength and friction. In general, the length of the string is about the distance from the user's shoulder to the floor.

The diabolo element includes a central body axle to which is joined spaced generally frusto-conical cup-like cones each of basically the same predetermined diameter at their ends with the pointed portion of the cones being in facing spaced relation. This provides an exposed length of axle between the pointed portions of the cones, the ends of said cones being spaced a predetermined distance and the cones being dimensioned so as to be symmetrically balanced on said axle so as to achieve a symmetrical rotation around the axis of the diabolo. The diabolo is rotated on its axis by the use of a string member secured at each end to the end of a stick member, the string member having a length generally the distance between the shoulder of the user and the floor, and wherein to effect spinning of the diabolo, the string member is located on the exposed length of the axle between the pointed portions of the cones and in which spinning of the diabolo in one direction is accomplished by manipulation of the sticks to effect accelerated rotation in one direction.

Various types of diabolo elements are known in the patent art, for example, that described in U.S. Pat. No. 3,745,697 of Jul. 17, 1973 and which is a self-illuminated diabolo top. Another diabolo spinning member is described in U.S. Pat. No. 3,883,985 of May 20, 1975.

In use, one starts the diabolo spinning by the use of the sticks and string. After it diabolo is spinning, a large variety of maneuvers may be carried out, including throws, pirouettes, side spins, spins around the arms or legs, just to mention a few. Normally, it is necessary for the diabolist periodically to re-spin the diabolo since it is essential that the diabolo be continuously spinning on its axis at a relatively high speed. It is also possible that juggling be carried out by two diabolists, passing one or more diabolos between them. Where the juggling involves only one diabolist, there are some limitations on what tricks can be performed. For example, the single diabolist is currently limited to the use of either the string or the sticks to perform juggling. It is not possible to throw the diabolo against a surface since this causes the diabolo to lose rotational speed and become unstable. For a professional and skilled diabolist who performs before an audience, the limitation imposed by the use of only the sticks and the string tends to impose some severe restrictions on the tricks which can be performed, i.e., the diabolist is limited to throws and catches, using one or more diabolos, or swinging and turning tricks.

Also known in the art are a variety or rebound devices and pitch back devices. For example, U.S. Pat. No. 4,693,472 of Sep. 15, 1987 describes a ball rebound net composed of a mesh whose squares are smaller than the ball or other item which hits the net. U.S. Pat. No. 5,558,338 of Sep. 24, 1996 describes a ball rebound device using a net whose mesh is smaller that the size of the ball which hits the net. U.S. Pat. No. 4,553,751 of Nov. 19, 1985 again describes a rebound device having a net whose mesh openings are smaller than the ball which hits the net. U.S. Pat. No. 5,007,638 of Apr. 16, 1991 describes a pitchback device in which a trampoline type net is used to propel a pitched ball back to the pitcher. While these prior art devices are suitable for their intended purposes, they are not useable for a diabolo since impact between the peripheral outer surfaces of the cones and the rebound net will result in the diabolo losing its spin. A diabolo which loses its spin is useless.

It is thus apparent that a need exists for an accessory device for use by a diabolist which permits a wide variety of diabolo juggling tricks which are not limited to the use of the sticks or string and which permits controlled throws and catches, as well as rebound tricks.

It is thus an object of this invention to provide a diabolo juggling accessory which permits the diabolist to perform a wide variety of diabolo juggling tricks which are not solely dependent upon the sticks and strings conventionally used by the diabolist or diabolists and which maintains the needed spin on the diabolo.

It is also an object of this invention to provide a relatively simple accessory for use in diabolo juggling which can be used by both the amateur and professional diabolist for juggling tricks which cannot be performed by either the string or sticks and which permits the diabolo to keep spinning during contact and rebound.

Yet another object of this invention is to provide a diabolo juggling accessory which includes one or more elastic members suitably arranged and spaced from each other and against which the diabolo may impact by contact with the portion of the axle between the pointed ends of the cones and which propels the diabolo in a variety of different directions depending upon the arrangement and orientation of the elastic members and the angle at which the diabolo hits one or more of the elastic members and wherein the elastic members are free of transverse members.

BRIEF DESCRIPTION OF THE INVENTION

The above and other objects are achieved in accordance with this invention by the provision of an accessory for use in diabolo juggling and more particularly to an improved diabolo juggling accessory which includes one or more stretchable and elastic members supported by a frame and in which the diabolo is thrown at the accessory so that it impinges on the elastic member so that the exposed axle portion between the spaced cones contacts the elastic member which causes the diabolo to rebound in a controlled direction without materially causing a loss in rotation or spin.

The diabolo juggling accessory of this invention may take any one of several forms. In its simplest form, a hand held unit, a frame is provided which supports one or more flexible, resilient elastic and stretchable members tightly stretched and secured between spaced frame members. The elastic member(s) are free to move in a forward or rearward direction with respect to the direction of impact of the diabolo and are free of any transverse members which prevent the presence of an open space on each side of the elastic member. The diameter of the elastic and stretchable members is preferably not greater than the portion of the axle of the diabolo between the pointed and facing portion of the diabolo cones.

In use, this form of accessory is held by the diabolist and used to catch the diabolo in the sense that the diabolo strikes and is propelled in a desired direction, relying in part on the elastic, resilient nature of the stretchable member which is impacted by the diabolo and to propel the diabolo away from the accessory. The diabolo impacts or impinges on the stretchable member by the latter contacting the small exposed axle section between the pointed ends of the cone. In this form, like the others to be described, since the diabolo is angled between the end of the diabolo cones and the pointed end of the cone, even if the diabolo is slightly off line with respect to the stretchable member, the angled faces of one or the other of the cones tends to center the diabolo axle on the stretchable member so little, if any, spin is lost on impact and return. In this way, as long as the diabolo is spinning at a sufficiently high speed, the diabolo can impinge upon and/or be thrown or propelled away in a variety of different ways.

In another form, the accessory is a free standing unit which can be taken apart for ease of movement to various locations, and which includes a frame having a horizontal section and a vertical section. The horizontal section preferably rests on legs on the floor or ground so that the horizontal section is spaced from the floor or ground. The horizontal section includes a horizontally arranged transverse mounting member, preferably adjustable along the length of the horizontal frame section, to which one end of the stretchable members may be secured, as will be described. The horizontal section also supports a vertically oriented frame section, spaced from the horizontally arranged transverse mounting member, the horizontal section including a horizontally disposed second transverse member, preferably adjustable along the vertical length of the vertical frame, at or near the top to which the other end of the stretchable members may be attached. The horizontal and vertical frame members are rigidly attached to each other and the transverse mounting members for the elastic stretchable members are, in turn, rigidly mounted to the horizontal and vertical frame members.

The transverse mounting members which are rigidly mounted on the respective frame members support a plurality of spaced stretchable and elastic members strung between the transverse mounting on the vertical frame member and the transverse mounting member on the far end of and spaced from the horizontal frame member. It is important that the elastic members be tightly stretched, in effect like a large, taut rubber band. It is also important that the elastic members be free of any transverse member which would prevent their independent resilient deflection or which would contact the cones of the diabolo. Since the stretched elastic member imposes a considerable stress on the transverse mounting members, it is important that the transverse members be rigid, rigidly mounted on the respective frame members and the latter rigidly mounted to each other.

The result is a plurality of spaced stretchable and elastic members which are oriented at basically the same inclined angle with respect to the horizontal and vertical frame members and which are free of any transverse members or ties. The inclined angle may be adjusted by adjusting the position of one or both of the transverse support members. It is also possible to have a second transverse support member mounted below the upper transverse support member on the vertical frame and to string a plurality of spaced elastic members between the transverse mounting members which are in a vertically spaced relation, so that the elastic stretchable members are vertically oriented. One may also locate a plurality of spaced stretchable elastic members between the lower vertically disposed transverse mounting member and the transverse mounting member on the horizontal frame such that the stretchable members are inclined at an angle different from those strung between the upper transverse support on the vertical frame and the transverse support on the horizontal frame.

The elastic stretchable members are preferably spaced from each other a distance which is sufficient to permit the large diameter end of the cones of the diabolo to pass between the spaces between the stretchable members so that one or more of the stretchable members engage the exposed axle portion of the diabolo. In some cases, only one stretchable member engages the axle, but in other cases as many as three stretchable members may engage the exposed axle portion. This is possible since the stretchable members are capable of being displaced laterally with respect to each other, while permitting the ends of the cones to pass between the spaces of those adjacent stretchable members not engaged by the diabolo.

The action of the diabolo, i.e., the return, depends on where the diabolo impinges along the length of the stretchable member, the angular orientation of the stretchable members, the angle of impact, the force of the throw and the direction of rotation of the diabolo. As a general observation, the greater force with which the diabolo hits the stretchable member, the greater the return. The direction of spin can cause the diabolo to rebound upwardly or downwardly, for example.

A diabolist may use a single free standing accessory of this invention or may use spaced accessories with the diabolist standing between the two. The free standing accessories may be spaced from about 10 to 30 feet apart. In this way, the diabolo can be bounced between the two units, bounced from one and caught using the sticks or the hand held unit and then bounced to the other. The variety of possible diabolo tricks is increased enormously, based on the skill of the diabolist, permitting tricks to be performed which have never before been performed.

This invention has many other advantages, and other objectives, which may be more clearly apparent from consideration of the various forms in which it may be embodied. Certain versions of such forms are shown in the drawings accompanying and forming a part of the present specification. These forms will now be described in detail for the purpose of illustrating the general principles of the invention; but it is understood that such detailed description is not to be taken in a limiting sense.

BRIEF DESCRIPTION OF THE DRAWINGS

FIG. 3 is a plan view of another form of a hand held diabolo accessory in accordance with this invention;

FIG. 6 is a fragmentary view illustrating the spacing of the elastic and stretchable members which are part of the diabolo accessory in accordance with this invention;

FIG. 7 is a fragmentary view of the elastic and stretchable members which are part of the diabolo accessory of this invention illustrating the impact of the diabolo on several such members;

FIG. 8 is a diagrammatic view of another form of free standing diabolo accessory in accordance with this invention; and FIG. 9 is a diagrammatic view illustrating the use of two of the free standing diabolo accessories in accordance with this invention.

DETAILED DESCRIPTION OF THE INVENTION

Figure 1:
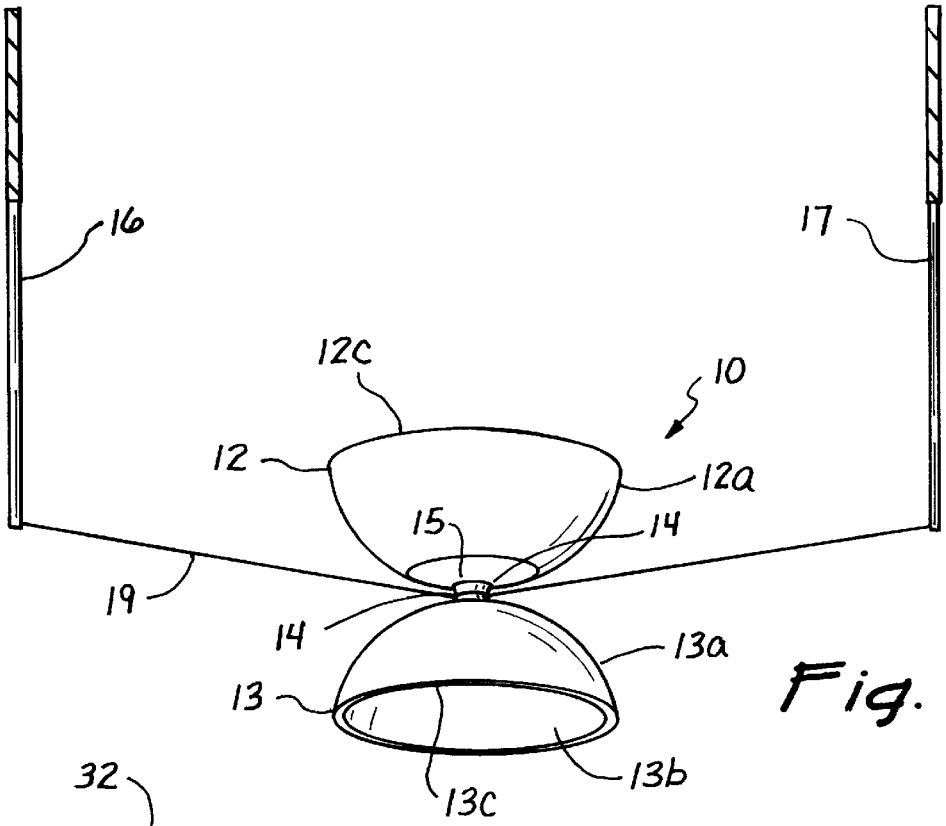
FIG. 1 is a diagrammatic view of a diabolo juggling device for purposes of illustration.

Referring to the drawings, which illustrate preferred forms of the present invention, the modern day prior art diabolo 10 is shown in FIG. 1 and includes two frusto-conical cups 12 and 13 mounted, normally bolted, on a central axle which holds the cups in spaced relation with the apex 14 of the cups facing each other. Each of the cups is in the form of a cone which face each other, with an exposed portion 15 of the axle between the cones. The side walls 12*a* and 13*a* of the cones flare outwardly and may be curved in a cup shape (the usual configuration) or straight. Normally the inside 12*b* and 13*b* of the cups are hollow or open. The diabolo's balance must be perfect and the structure quite rigid, as well as being shock-resistant and durable.

As already noted, the diabolo element 10 may vary in size both in diameter of the cones and the overall length between the end faces 12*c* and 13*c* of the cones, it being of the utmost importance that the unit be in perfect balance along the axis and transverse of the axis of the diabolo. This is because the use of the diabolo requires that it be rotating along its axis at a relatively high speed, as contrasted to wobbling or gyrating. Typical dimensions have already been discussed.

Use of the diabolo involves a pair of sticks 16 and 17, usually wood such as beech or pine, having the dimensions already described. To the end of each stick is tied a special string 19 which is flexible, non-elastic and non-stretchable, typically having a composition as already described and a length between the sticks as already described.

Each of the diabolo cones are each of basically the same predetermined diameter at their ends with the pointed portion of the cones being in facing spaced relation, the ends of said cones being spaced a predetermined distance and the cones being dimensioned so as to be symmetrically balanced on said axle so as to achieve a symmetrical rotation around the axis of the diabolo. The diabolo is rotated on its axis by the use of the string member 19 secured at each end to the end of sticks 16 and 17, the string member having a length generally the distance between the shoulder of the user and the floor, and wherein to effect spinning of the diabolo, the string member is located on the exposed length of the axle between the pointed portions of the cones and in which spinning of the diabolo in one direction is accomplished by manipulation of the sticks to effect accelerated rotation in one direction. With this background related to a diabolo juggling device, the various forms of the diabolo accessory in accordance with this invention may be better understood.

Figure 2:
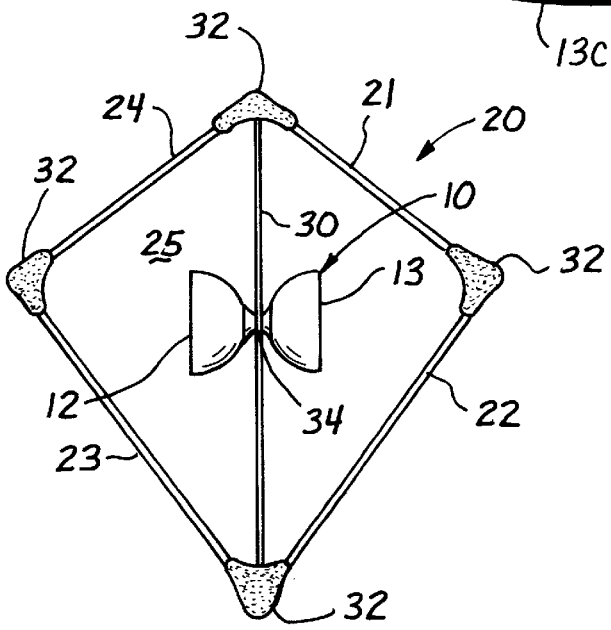
FIG. 2 is a plan view of one form of a hand held diabolo accessory in accordance with this invention.

One form of a hand held diabolo accessory 20 in accordance with this invention is shown in FIG. 2. The accessory 20 includes spaced frame members 21, 22, 23 and 24 which are relatively lightweight and preferably of a high strength material such as tubular aluminum for light weight or steel tubing to form a rigid high strength support frame assembly having an open region 25 between the frame members. This form of the accessory 20 is of a size and weight such that it can be relatively easily manipulated by the diabolist. Carried by and mounted on the frame is at least one resilient, flexible, stretchable, elastic member 30 which can be stretched and which returns to its original length and which is mounted under tension. The elastic member is free of any transverse member attached to it.

The elastic member is assembled and is under considerable tension. One item which may be used as the elastic member, and preferred in accordance with this invention, is what is commonly known as a bungee cord. The cords include hooks on each end of the cord, the cord itself basically including a stretchable core covered by an axially stretchable outer fabric member, the cord being secured in the hooks as is already well known.

As shown, the corners of the accessory 20 may be padded, as shown at 32, to protect the accessory in the event it is dropped and to prevent the accessory from marking the surface on which it is dropped. It is not uncommon for a professional diabolist to drop the accessory during a performance in order to pick up quickly some other item during the juggling act. Sometimes the accessory is inadvertently dropped.

In a preferred form, as shown in FIG. 2, the diameter of the elastic member 30 is not greater than the exposed length of the axle 34 between the cones 12 and 13 of the diabolo 10. In this way, the elastic member 30 tends not to contact the side wall of the cones and thus tends not to reduce the rotation of the diabolo when it impinges upon and/or is propelled away from the accessory 20. Even if initial contact is with the curved or tapered side wall of the diabolo, the diabolo tends to shift such that the elastic member is positioned in the region of the exposed length of the axle.

As shown, the accessory 20 is manipulated and oriented by the user to cause impingement of the diabolo such that the axis of the elastic member 30 is a right angle to the axis of the diabolo, with the accessory being sufficiently light weight to be manipulated so that the exposed axle is aligned with the axis of the elastic member. This can be done by gripping the frame elements and moving the accessory into the proper orientation with respect to the rotating diabolo.

It is important that the cones not contact anything when the diabolo exposed axle 34 contacts the elastic member 30. To this end, a clearance on each side of a majority of the length of the elastic member is provided not having any cross members attached to the elastic members between adjacent elastic members and by having the frame members spaced from the elastic member by a distance which is preferably at least one half the distance between the ends 12*c* and 13*c* of the cones. Thus, the open region 25 is not less than the distance between the ends of the diabolo cones.

In use, the accessory 20 can be held in a fixed position relative to the direction of travel of the diabolo such that the diabolo contacts the elastic member which propels the diabolo away from the accessory due to the elastic nature of the elastic member 30.

FIG. 3 illustrates another form of a hand held accessory 40, similar to that of the accessory of FIG. 2. In this form, the frame members are symmetrical, made of light weight aluminum tubing and includes at the spaced joints 42 a un-shaped loop 44 for mounting the elastic member 30, again in the form of a bungee cord. In this form the hook of the bungee cord can be assembled to the un-shaped loop and the bungee cord is held centered in the frame. Again, the frame members are spaced sufficiently far from the elastic member 30 so as to provide a clearance, as already described.

Figure 4:
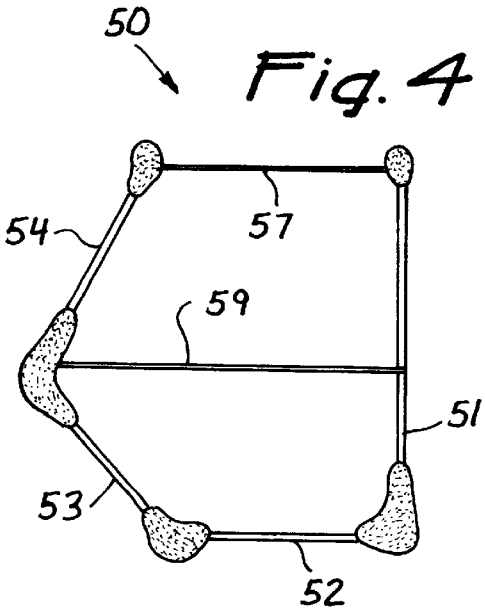
FIG. 4 is a plan view of yet another form of a hand held diabolo accessory in accordance with this invention.

Another form of hand held accessory 50 is illustrated in FIG. 4. Again, the unit includes spaced frame members 51, 52, 53 and 54 forming a rigid frame assembly composed of the tubular materials already described. In this form, the accessory includes two separate elastic members 57 and 59, again, preferably bungee cords, one at the end of the frame and the other in the middle of the frame. The elastic members 57 and 59 are spaced such that a diabolo may pass between them, or contact one without contacting the other and each elastic member is free of transverse members. In this form, the accessory may be oriented such that the diabolo comes down on one or the other elastic members 57 and 59, with the accessory disposed in a horizontal plane. The diabolo can then be bounced between the elastic members 57 and 59. The accessory may also be oriented in a vertical orientation so that the diabolo impinges upon and is bounced away from the elastic member 57. If held at some position between the vertical and horizontal, the diabolo may impinge on elastic member 59 and bounce to 57, back to 59 and then away. Any number of different strikes and bounces are possible with this configuration.

The accessories may be used both by amateurs and professionals. However, the present invention also provides a more sophisticated stand alone unit more suitable for use by a professional.

Figure 5:
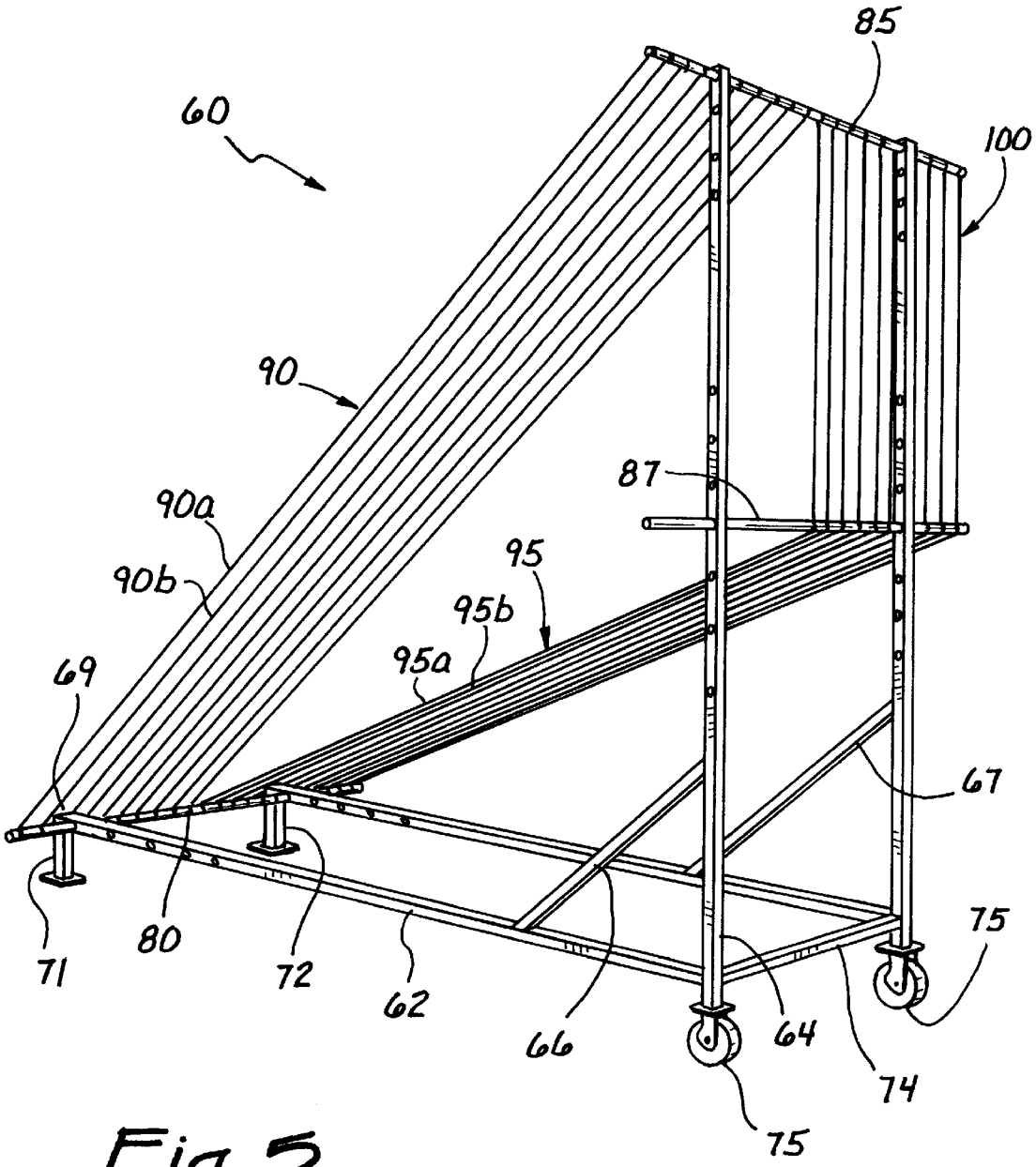
FIG. 5 is a perspective view of a free standing diabolo accessory in accordance with the present invention.

Referring to FIG. 5, a free standing form of the accessory 60 is shown which includes a horizontal frame member 62 joined to a vertical frame member 64 with braces 66 and 67 between the two frame members, as illustrated, to provide a secure rigid mounting between the two. The front end 69 includes legs 71 and 72 at each corner of the horizontal frame to support the front end off the ground or floor. The rear end 74 of the horizontal frame includes wheels 75 permitting the accessory to be moved around and positioned in the desired location and orientation.

Removably attached to the front end 69 of the horizontal frame is a transverse mounting member 80 which may be releasably positioned axially, but rigidly, along the length of the horizontal frame. The vertical frame 64 also includes a transverse mounting member 85 releasably mounted at the top end thereof, as shown, the latter being positionable at various points along the vertical frame 64. The transverse members 80 and 85 are disposed in essentially spaced parallel relation to each other and in different planes, one vertically above the other, but laterally displaced.

The vertical frame 64 may also have adjustably, but rigidly mounted thereon a second transverse mounting member 87 which may also be positioned at a given vertical position above the horizontal frame 62 and below the upper transverse mounting member 85. The transverse mounting members act as mounting elements for a series of elastic elements, i.e., bungee cords.

In a preferred form, a series of bungee cords 90 extend between the transverse mounting member 80 and mounting member 85, one side of the accessory 60 and between the vertical frame and the front 69 of the horizontal frame. Again, there are no transverse members interconnecting the cords and each elastic member includes a clearance space extending along its length.

As shown, this set of cords is oriented at an inclined angle with respect to the horizontal. The angular orientation may be varied by varying the position of either or both of the transverse support members 80 and 85. The purpose for varying the angular orientation of the set of cords is to permit various types of rebound effects, depending upon the angle of this cord set.

This set of cords or elastic members 90 includes a plurality of individual elastic members or bungee cords, 90*a,* 90*b,* etc., mounted on the respective transverse mounting members in spaced parallel relation, the set being disposed between the side frame portions of both the horizontal and vertical frame members.

In a preferred form, a second set of elastic members or bungee cords 95, again including a plurality of individual elastic members 95*a,* 95*b,* etc., mounted at one end on the lower transverse mounting member 87 and at the other end on the transverse mounting member 80, but spaced laterally from the first set 90. The second set of cords 95 is at an angular orientation different from the first set.

Again, in a preferred from, a third set of elastic members, i.e., bungee cords, 100 is disposed vertically between the upper transverse mounting member 85 and the lower transverse mounting member 87, each of which is mounted on the vertical frame member 64. This third set of cords 100 is displaced laterally from the first set 90, but vertically above the second set 95. In fact one end of the bungee cords making up the third set is attached to the lower transverse mounting member 87 in the same zone in which the one end of the second set 95 is mounted. The result is that the third set of cords 100 is located to the rear of the second set 95 but oriented vertically.

It is to be noted that each elastic member of each set is spaced along its length from and adjacent elastic member to form a clearance space extending along the axis of the cord as well as from any frame member. It is preferred that the elastic member or sets of elastic members be located relative to the frame members such that the diabolo may contact an elastic member at the axle portion between the cones, but not contact any portion of the frame itself or any transverse member between adjacent cords. It must be remembered that as the diabolo contacts a particular elastic member, the latter deflects in the direction of the travel of the diabolo and there should not be any fixed member which prevents this deflection.

With an accessory such as 60, as shown in FIG. 5, the diabolist is provided with a versatile adjunct to juggling with a diabolo. This form of accessory may be disassembled to make it easier to move from place to place by structuring members 62, 74 and 87 so that the accessory can be collapsed for movement. The versatility of use includes not only that of movement, but that of use. For example, if the diabolo hits the first set of cords 90, depending on the direction of rotation and where along the length of the cords, the diabolo may rebound in an upward or downward direction by a greater or lesser amount, where it may impinge upon the hand held accessories, already described, or by the diabolo stick and string if it is necessary to speed up the spinning of the diabolo. Alternatively, the diabolo may be directed to the second set of cords 95, and again, depending on the direction of rotation and where the diabolo strikes along the length of the cord, may be returned at a different angle or amount or both, from the return from the first set, or propelled to the third set 100 and returned by that set. In yet another possible maneuver, the diabolo may be directed to the third set of cords 100 and, depending upon the direction of rotation, may be propelled upwardly and away from the third set or towards the second set and out to the front of the unit. It is apparent that the return is greatest when the diabolo strikes the midpoint along the length of a cord since this provides the greatest deflection for a given force. Thus, a highly versatile accessory is provided for the diabolist.

As seen in FIG. 6, the spacing between the pairs of adjacent elastic members 102, 103 and 104 is such that the spacing is slightly more than one half the length of the diabolo 105, as measured from the midpoint 108. Of course, the spacing between adjacent cords may be varied by the diabolist depending upon the overall axial length of the diabolo. It is also the case that there is a clearance on each side of each cord and preferably to the rear of each cord so that the latter may flex rearwardly free of contact with any item. In any event, the cords are preferably spaced such that the cones 105*a* and 105*b* pass between adjacent cords 102 and 103 and 103 and 104 when the diabolo exposed axle is engaged by cord 103. In this way, the cones of the diabolo do not contact the cords with the result that the speed of the diabolo is reduced. Moreover, there is an open region in the frame and the cord sets or the cord is located in this open region, again to prevent contact between the diabolo and any portion of the frame member.

Referring now to FIG. 7, there are conditions under which a diabolo 105 may contact more than one elastic member. This can occur if the spacing between adjacent cords 110–114 is less than the distance from the exposed center portion of the axle 108 to the end 105*c* of the cones, i.e., the dimension from the center of the axle to the end of the cones is greater than the spacing between adjacent cords. In this particular case, the diabolo may engage two or three cords, causing a lateral deflection of the cord as it rides over the outer surface of the cone(s) towards the center portion of the axle. Since there is a clearance space on each side of each cord and there are no transverse members interconnecting adjacent cords, the cords can deflect to the center axle 108 of the diabolo.

FIG. 8 illustrates another form of free standing accessory 120 which includes a base 122 forming a horizontal frame member, a vertical frame member 123 connected to the base 122 and transverse mounting members. One transverse mounting member 125 is mounted at the top of the vertical frame, as shown, and adjustable vertically. Vertically below the top of the vertical frame member are two transverse mounting members 127 and 129, the latter being adjustably secured to the mid-frame horizontal member 130. Strung between the transverse mounting members 125 and 127 and 125 and 129 are two separate sets of elastic members 135 and 140, respectively. Each of the sets of elastic members or cords are as already described as to type and arrangement.

The accessory 120 of FIG. 8 may be used by a single diabolist or two diabolists, each using one side of the accessory. The accessory of FIG. 8 may also be used in conjunction with any of the accessories already described.

FIG. 9 illustrates the versatility which can be achieved with the accessories of this invention. As seen, two free standing accessories 150 and 160, as already described may be positioned in spaced alignment. The distance between the units can be anywhere from six feet to thirty feet. One or more diabolists may stand between the two units and by use of the sticks or the hand held accessories or a combination of both, may propel one or more diabolos between the accessories 150 and 160. One may also use the accessory of FIG. 8 with the units shown in FIG. 9. The result is that the spectrum of available diabolo tricks and juggling routines available to the diabolist(s) is rapidly expanded, giving rise to some very creative displays of juggling.

It should be understood that this invention is not limited to the detailed descriptions set forth herein which describe in detail preferred forms of the present invention. Modifications thereof will be apparent to those skilled in the art, based on the above detailed disclosure, but such modifications based on this disclosure may not be deemed to depart from the spirit and scope of the present invention as set forth in the appended claims.

What is claimed is:

1. An accessory and diabolo for diabolo juggling comprising a diabolo and an accessory, said diabolo including a central body axle to which is joined spaced generally frusto-conical cup-like cones each of basically the same predetermined diameter at their ends with the pointed portion of the cones being in facing spaced relation so as to provide an exposed length of axle between the pointed portions of the cones, the ends of said cones being spaced a predetermined distance and the cones being dimensioned so as to be symmetrically balanced on said axle so as to achieve a symmetrical rotation around the axis of the diabolo, and wherein the diabolo is initially rotated in one direction on its axis, said accessory comprising:

a support frame including spaced frame members for providing an open region between the spaced frame members, at least one resilient, flexible, stretchable and elastic member positioned in said open region between said frame members and secured at each end to said frame members, said at least one resilient member being free of transverse cross-members along its length so as to provide a free space on each side of the resilient member, and the frame members being spaced from the resilient member, whereby at least one rotating diabolo may be propelled at said accessory such that ends of the diabolo are capable of passing through the free space, and whereby the axle between the cone impinges on said resilient member and the rotating diabolo element impinges upon and/or is propelled away from said resilient member.

2. An accessory and diabolo for diabolo juggling as set forth in claim 1 wherein said support frame includes at least two of said resilient members mounted side by side and in spaced relation to each other.

3. An accessory and diabolo for diabolo juggling as set forth in claim 1 wherein said at least two of said resilient members are positioned in spaced parallel relationship.

4. An accessory and diabolo for diabolo juggling as set forth in claim 1 wherein said support frame of said accessory includes a horizontally disposed frame member and a vertically disposed frame member, a transverse support member mounted on each of said horizontal and vertical frame members, and a plurality of said spaced resilient members mounted on each of said support members and oriented at an angle with respect to the horizontal frame member.

5. An accessory and diabolo for diabolo juggling as set forth in claim 4 further including a second transverse support member mounted on said vertical frame below the transverse member mounted thereon, and a plurality of said spaced resilient members mounted on said second transverse support member at one end and on said transverse support member mounted on said horizontal frame member.

6. An accessory and diabolo for diabolo juggling as set forth in claim 4 further including a second transverse support member mounted on said vertical frame below the transverse member mounted thereon, and a plurality of said resilient members extending between said second transverse support member and the transverse support member mounted on said vertical frame member.

7. An accessory and diabolo for diabolo juggling as set forth in claim 4 wherein said transverse support members are adjustable with respect to the frame member on which they are carried.

8. An accessory and diabolo for diabolo juggling as set forth in claim 1 wherein the diameter of said at least one resilient member is not greater than the exposed length of axle between the cones of the diabolo.

9. An accessory and diabolo for diabolo juggling as set forth in claim 1 wherein a single said resilient member is mounted directly on said frame members.

10. An accessory and diabolo for diabolo juggling as set forth in claim 1 wherein said at least one of said resilient members is mounted on transverse support members carried on said frame members.

11. An accessory and diabolo for diabolo juggling as set forth in claim 1 wherein said frame member includes a vertically extending frame member, horizontally disposed frame members arranged on each side of said vertically disposed frame members, and a plurality of spaced, side by side said resilient members extending from said vertically extending frame member to each of said horizontally disposed frame members.

12. An accessory and diabolo for diabolo juggling as set forth in claim 4 wherein said horizontal frame member is supported off the ground.

13. An accessory and diabolo for diabolo juggling as set forth in claim 4 wherein said accessory includes wheels for moving the accessory from one position to another.

14. An accessory and diabolo for diabolo juggling as set forth in claim 1 wherein said accessory includes a plurality of said resilient members disposed at one angular orientation and a separate plurality of said resilient members disposed at another angular orientation.

15. An accessory and diabolo for diabolo juggling as set forth in claim 1 wherein said accessory includes a plurality of spaced side by side said resilient members, said resilient members being capable of moving laterally with respect to each other.

16. An accessory and diabolo for diabolo juggling comprising:

a diabolo and an accessory for use with said diabolo, said diabolo including a central body axle joined to spaced generally frusto-conical cup-like cones each of basically the same predetermined diameter at their ends with the pointed portion of the cones being in facing spaced relation so as to provide an exposed length of axle between the pointed portions of the cones, the ends of said cones being spaced a predetermined distance and the cones being dimensioned so as to be symmetrically balanced on said axle so as to achieve a symmetrical rotation around the axis of the diabolo, said accessory including:

a support frame including spaced frame members for providing an open region between the spaced frame members, at least one resilient, flexible, stretchable and elastic member positioned in said open region between said frame members and secured at each end to said frame members, the frame members being spaced from said at least one resilient member a distance sufficient to permit impingement of said diabolo on said resilient member without contacting a frame member, and said at least one resilient member including a free space on each side thereof which is free of cross-members attached thereto whereby at least one rotating diabolo element may be propelled at said accessory such that ends of the diabolo are capable of passing through the free space and contacting said resilient member.

17. An accessory and diabolo for diabolo juggling as set forth in claim 16 wherein said support frame includes at least two said resilient members mounted side by side spaced parallel relation to each other.

18. An accessory and diabolo for diabolo juggling as set forth in claim 16 wherein said support frame includes frame members disposed in a horizontal and a vertical orientation, a transverse support member mounted on each of said horizontal and vertical oriented frame members, and a plurality of said spaced resilient members mounted on each of said support members and oriented at an angle with respect to the horizontal frame member.

19. An accessory and diabolo for diabolo juggling as set forth in claim 17 wherein said spaced resilient members are spaced apart a distance greater than the distance between the ends of the diabolo.

20. An accessory and diabolo for diabolo juggling as set forth in claim 16 wherein the accessory is relatively rigid and light weight so as to be manipulated manually by a diabolist.

* * * * *